US005505373A

United States Patent [19]

von Stillfried

[11] Patent Number: 5,505,373

[45] Date of Patent: Apr. 9, 1996

[54] FOLDING PACKAGE

[75] Inventor: Christoph G. von Stillfried, Tutzing, Germany

[73] Assignee: David Hossein Todjar-Hengami, Redondo Beach, Calif.

[21] Appl. No.: 401,420

[22] Filed: Mar. 9, 1995

[30] Foreign Application Priority Data

Mar. 10, 1994 [DE] Germany ..... M9401659.3

[51] Int. Cl.[6] ..... B65D 43/12

[52] U.S. Cl. ..... 229/129.1; 229/122; 229/220

[58] Field of Search ..... 229/122, 125.12, 229/125.125, 129.1, 220

[56] References Cited

U.S. PATENT DOCUMENTS

| | | | |
|---|---|---|---|
| 1,432,932 | 10/1922 | Weis . | |
| 2,254,608 | 9/1941 | Heyer . | |
| 2,330,926 | 10/1943 | Rous | 229/220 |
| 2,426,911 | 9/1947 | Williamson . | |
| 2,628,761 | 2/1953 | Yancey | 229/125.12 |
| 2,903,175 | 9/1959 | Peiner | 229/220 |
| 3,033,436 | 5/1962 | Peiner | 229/220 |
| 3,071,306 | 1/1963 | Trethewey . | |
| 3,400,874 | 9/1968 | Shinada et al. | 229/129.1 |
| 3,819,093 | 6/1974 | Frobes, Jr. . | |
| 4,081,128 | 3/1978 | O'Neill | 229/220 |
| 4,094,456 | 6/1978 | Raccaforte . | |
| 4,197,985 | 4/1980 | Austin | 229/220 |
| 4,201,329 | 5/1980 | Roccaforte | 229/125.12 |
| 4,671,449 | 6/1987 | Fronduti . | |
| 4,779,793 | 10/1988 | Runo et al. | 229/125.12 |
| 5,158,635 | 10/1992 | Schmierer et al. | 229/125.12 |
| 5,348,219 | 9/1994 | Brintazzoli . | |
| 5,429,297 | 7/1995 | Walsh | 229/220 |

*Primary Examiner*—Gary E. Elkins
*Attorney, Agent, or Firm*—Poms, Smith, Lande & Rose

[57] ABSTRACT

A box for conveniently storing and dispensing food has a back wall and a slide connected to the back wall. The slide has a slide opening and two side tabs extending from the slide. A front wall with an opening is connected to the back wall. The box also has an interior supporting wall having first and second side slits. The slide is disposed within the box, with each of the tabs being inserted into a corresponding one of the slits. The box has an open position in which the openings are aligned and in which the contents of the box may be poured out, and a closed position. The box may be made of sulfate cellulose cardboard.

16 Claims, 2 Drawing Sheets

FOLDING PACKAGE

BACKGROUND OF THE INVENTION

1. Field of the Invention

The present invention concerns the field of packaging for candy, especially fruit gummi candy products.

2. Prior Art

Fruit gummi candies are currently being distributed mainly in bags. Such bags are an inexpensive form of packaging, but they have several disadvantages from the standpoint of the consumer. First, the package is noisy when opened, which is perceived as annoying in a movie theater, for example. Furthermore, the bag often tears so far down when being opened that some of the contents fall out. In addition, the fruit gummi candies in such bags often stick together and form a "lump." Finally, such bags cannot be resealed, so the candy loses its flavor after the package has been opened.

The present invention is based on the problem of creating a package for candy, especially fruit gummi candy, that will not have the disadvantages mentioned above.

SUMMARY OF THE INVENTION

This task is solved by this invention which uses a package made of a sulfate cellulose-cardboard box with a reclosable opening of a certain size as the container for fruit gummi candies. Since a sulfate cellulose-cardboard box is used as the packaging material, the fruit gummi candy stored within is protected from loss of flavor for a long period of time. This is true before the box package is opened for the first time as well as afterwards. Furthermore, the box can be opened and closed again noiselessly. In addition, the rigidity of the box prevents pressure from acting on the fruit gummi candy to cause it to stick together. Additional advantages of this invention include the fact that this box can be recycled and is suitable for display- i.e., these boxes can be exhibited in retail cases without requiring an outer package (cardboard, etc.). Finally, another advantage is that the resealable opening provided in the box may have an optimum size tailored to the [individual size of the] packaged fruit gummi candy. This solves the familiar problem that when tearing open such a bag, the tear often goes so far that some of the contents fall out.

An advantageous box for candy, especially fruit gummi candy, has a front wall, a back wall, two side walls and a top flap and a bottom flap, where the front wall has an opening and a slide is provided in contact with the front wall, so it can be moved between one position exposing the opening in the front wall and another position covering it. The top flap of the box can be lifted and the slide is attached to it. Since the opening for dispensing the candy is provided in the front wall, there is enough room to design the opening to fit the individual size of the candy. Even with a large opening, however, there is no loss of flavor of the fruit gummi candy even after storage for a long period of time in the box, because the slide in contact with the front wall on the inside seals the opening to keep in flavor. Especially good results with regard to preserving the flavor are obtained when the box is made of sulfate cellulose cardboard. To open the opening and close it again requires only lifting the slide and pushing it back beneath/behind the front wall, which is easily accomplished by having the slide attached to the top flap of the box which can be lifted up. The box can easily be opened and closed with one hand.

The top flap that can be lifted is preferably attached to the back wall by a fold line in an articulated joint. However, within the scope of this invention it is also conceivable for the top flap to be attached to one of the side walls.

A preferred design of the box according to this invention is characterized in that a supporting wall that has an opening that corresponds to the opening in the front wall is provided next to the inside of the front wall. The slide can move between the front wall and the supporting wall. This yields an even more effective flavor barrier, so that fruit gummi candy can be stored in the box for a long period of time without any negative effects on taste. No cellophane outer wrap is necessary for this box. The supporting wall is preferably attached to the back wall by one of the two side walls or a partition in contact with one of the side walls on the inside.

In another preferred design of this invention, the slide of the box is itself provided with an opening of a shape that corresponds essentially to the shape of the opening on the front wall. Such a design of the box is especially expedient when the opening is to be provided relatively far toward the top of the front wall. However, if the opening is located lower on the front wall, e.g., in the middle, then the slide need not have any opening of its own. Instead, its lower edge can then open or close the opening in the front wall.

A stop is preferably provided to define the position of the slide that exposes the opening in the front wall. Such a stop prevents the slide from being pulled completely forward under the front wall so that it must be pushed back behind it again in order to close the opening. Various designs are possible for such a stop. It may work between the slide and the front wall. However, for a box having a supporting wall behind the front wall, the stop preferably acts between the slide and the supporting wall. In this way, the front wall can be designed exclusively on the basis of esthetic or advertising considerations. In an expedient design of this invention, the stop includes at least one slit in the supporting wall so that the tongue connected to the slide is guided into the slit.

This invention is explained in greater detail below on the basis of a preferred design illustrated in the figures, which show the following:

DETAILED DESCRIPTION OF THE PREFERRED EMBODIMENT

Figure 1:
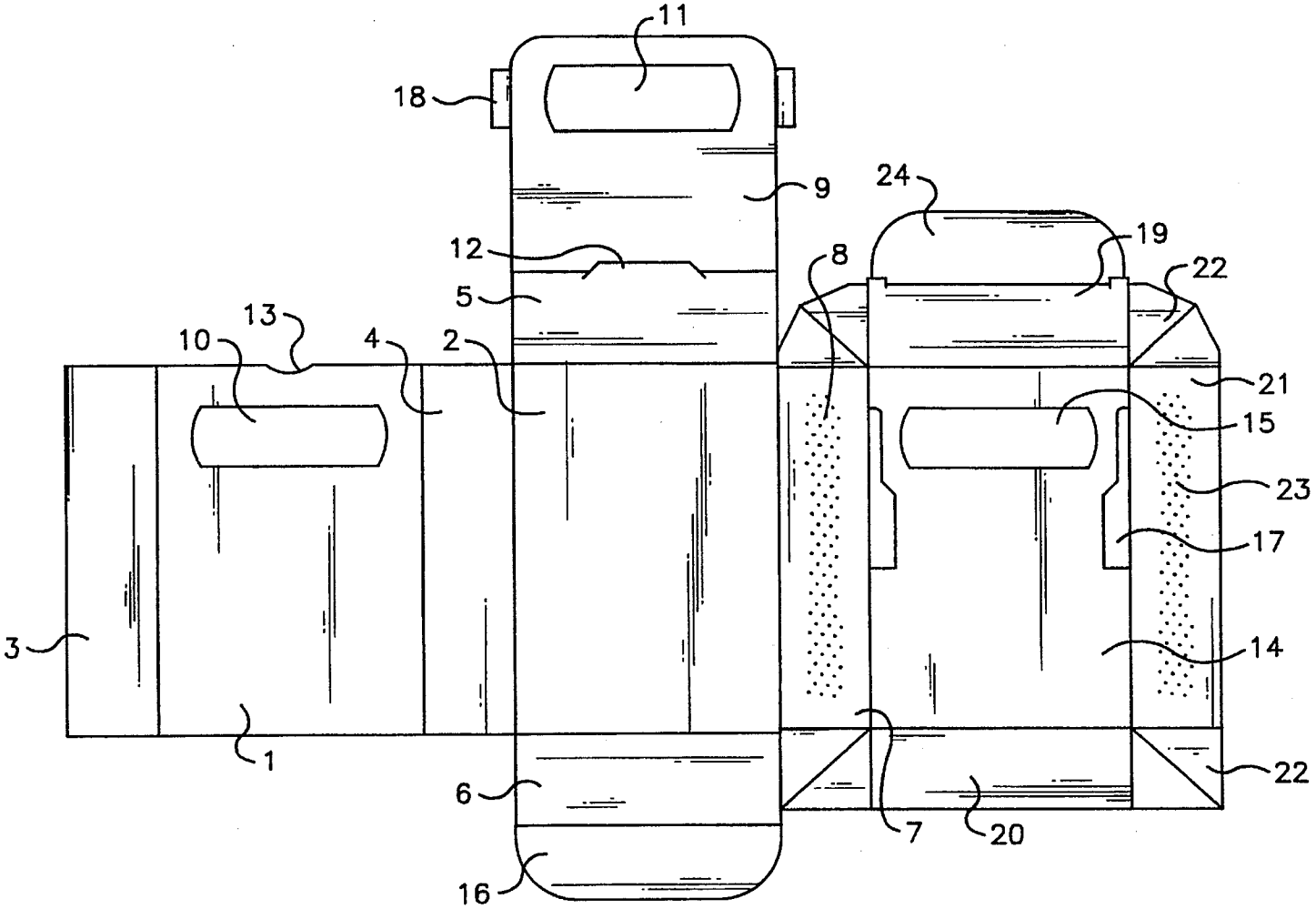
FIG. 1 shows the cross-section for a box according to this invention.
Figure 2:
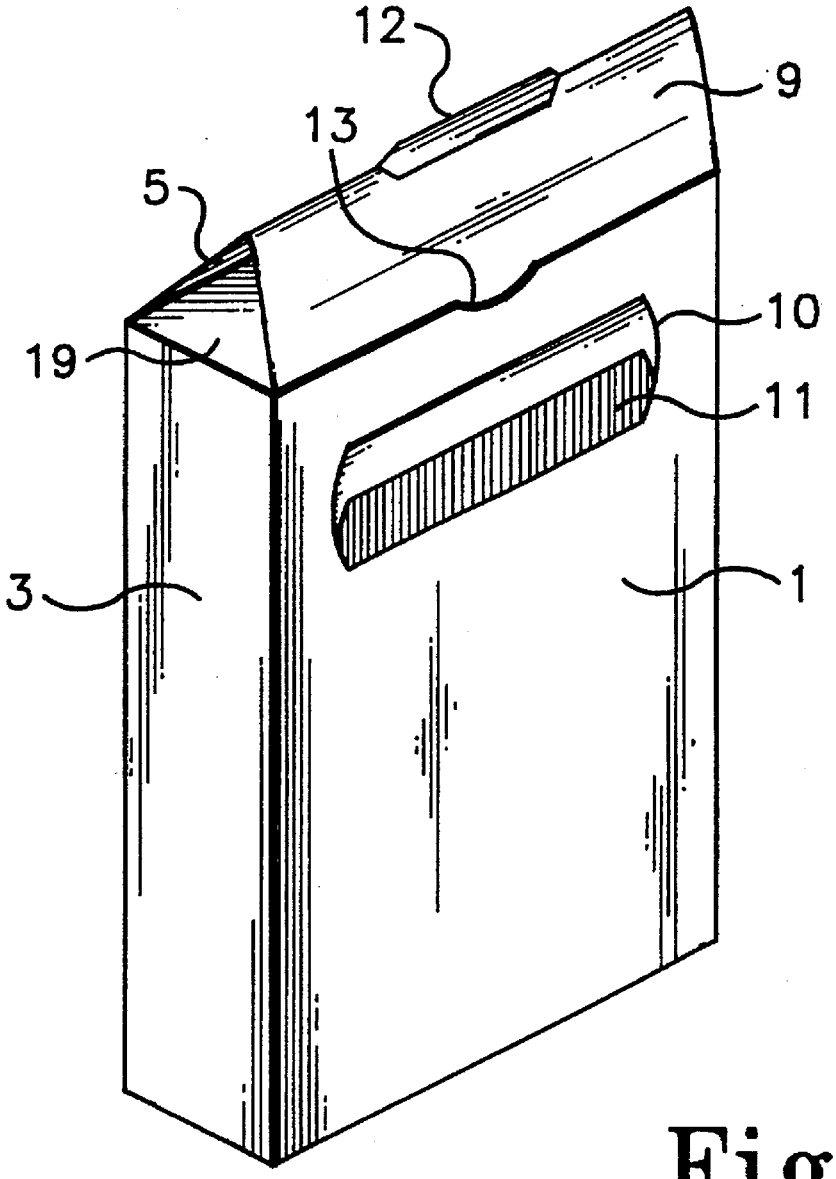
FIG. 2 shows a perspective view of the box designed from the cross-section according to FIG. 1 in a half-opened state.

The cubical box designed from the cross-section according to FIG. 1 has six outer walls, namely a front wall 1 and a back wall 2, a first side wall 3 and a second side wall 4 and a top flap 5 and a bottom flap 6. Between two of these walls the cross-section has folding lines F that define the edges of the finished box. A partition 7 is connected to the back wall 2 by a folding line. Partition 7 has a coating 8 of adhesive to bond the partition to the inside surface of the first side wall 3.

A bottom tongue 16 is connected to the bottom flap and its outside surface is in contact with the inside surface of front wall 1 when the box is completely assembled. A slide 9 is connected to the top flap 5 by a folding line and its outside surface is also in contact with the inside surface of front wall 1 when the box is fully assembled.

Front wall 1 has an opening 10. A corresponding slide opening 11 with a matching shape is provided in slide 9. When the top flap 5 is raised by thumb flap 12, slide 9 is raised along the inside surface of front wall 1 so the slide opening 11 comes to cover the opening 10 in front wall 1. Now the fruit gummi candy or similar candy product can be shaken out of the box through the corresponding openings in the front wall 1 and slide 9. When pressure is applied from above to push the top flap 5 of the slide 9 down behind the front wall 1, the unperforated section of slide 9 closes off the opening 10 in the front wall. A recess 13 that facilitates the engagement of thumb flap 12 is provided in the front wall 1 in order to make it easier to open the box.

A supporting wall 14 is connected to the partition 7. When the box has been fully assembled, the supporting wall is on the inside next to the front wall 1. It has essentially the same dimensions as the front wall 1, and specifically it has an opening 15 which corresponds to the opening 10 in the front wall when the box is fully assembled.

The slide 9 is between the front wall 1 and the supporting wall 14 when the box is assembled, as is the lower tongue 16 that is connected to the bottom flap 6. The supporting wall 14 has two slits 17. The two straps 18 that project at a right angle from the slide in the direction of the interior of the box after the box has been assembled engage into these two slits. This forms a stop that defines the position of the slide 9 with regard to the supporting wall 14 and the front wall 1 when the box is open and prevents the slide from pulling out of the space between front wall 1 and supporting wall 14.

A top inner wall 19, a bottom inner wall 20 and a side inner wall 21 are attached to the side wall 14. There are four corner flaps 22, each arranged in a corner between the inner walls and the partition. The corner flaps are attached to the neighboring walls by fold lines, and another fold line divides each corner flap into two parts, so the corner flaps are folded into the inside of the box when the box is assembled.

The inner side wall 21 has an adhesive coating 23 for bonding it to the inside surface of the second side wall 4.

When the box is assembled, the bottom inner wall 20 is beneath the bottom flap 6 and the top inner wall 19 is beneath the top flap 5. The top tongue 24 that is attached to the top inner wall 19 is in contact with the inner surface of the back wall 2. The top inner wall 19 seals the box at the top, even when the top flap 5 is raised in order to open the box at openings 10, 11 and 15 by lifting the slide.

I claim:

1. A box for conveniently storing and dispensing food comprising:

a front wall having an opening and an inside surface;

a back wall;

a first and a second side wall;

a top and a bottom flap;

a slide that is in contact with the inside surface of the front wall, said slide having an opening;

wherein said front wall, said back wall, said first and second side walls, and said top and bottom flaps are interconnected so as to form a box, said slide being movable between an open position in which said slide opening substantially aligns with said front wall opening and a closed position in which said slide opening is entirely out of alignment with said front wall opening, thereby closing said box.

2. A box as defined in claim 1, wherein said box further comprises a supporting wall disposed adjacent to the inside surface of said front wall, said supporting wall having an opening that is aligned with said front wall opening.

3. A box as defined in claim 2, wherein said slide is disposed in between said front wall and said supporting wall.

4. A box as defined in claim 2, wherein said box further comprises a partition that connects said supporting wall to said back wall.

5. A box as defined in claim 1, wherein the opening in said slide is substantially the same shape as the opening in said front wall.

6. A box as defined in claim 1, wherein said box has a stop for defining the position of said slide in said open position.

7. A box as defined in claim 6, wherein said stop is disposed in between said slide and said front wall.

8. A box as defined in claim 2, wherein said box has a stop for defining the position of said slide in said open position, said stop being disposed in between said slide and said supporting wall.

9. A box as defined in claim 1, wherein said slide further comprises a tongue, said supporting wall has a slit, and said tongue is disposed within and is guided by said slit.

10. A box as defined in claim 1, wherein said top flap is connected to said back wall in an articulated manner, such that a user may lift said top flap to slide said slide between said open and said closed positions.

11. A box for conveniently storing and dispensing food comprising:

a back wall;

a slide connected to said back wall, said slide having a slide opening and two side tabs extending from said slide;

a front wall connected to said back wall, said front wall having an opening;

a interior supporting wall having first and second side slits;

said box being made of sulfate cellulose cardboard;

wherein said slide is disposed within said box, each of said tabs being inserted into a corresponding one of said slits, and said box has an open position in which said openings are aligned and in which the contents of said box may be poured out of the box through said openings only, and a closed position in which said openings are not aligned and in which the contents of said box cannot be poured out of said box.

12. A box as defined in claim 11, wherein said box further comprises a thumb flap adjacent to said slide.

13. A box as defined in claim 11, wherein said openings are elongated.

14. A box as defined in claim 11, wherein said supporting wall includes an opening, said opening being substantially aligned with the opening in the front wall.

15. A box as claimed in claim 12, wherein said box is made of sulfate cellulose cardboard.

16. A box for conveniently storing and dispensing pourable food comprising:

a back wall;

a top flap having an upper portion and a lower portion, said top flap being connected at its lower portion to said back wall, said top flap being separated from said back wall by a first fold line;

a slide connected to said top flap, said slide having an elongated slide opening and two side tabs extending from said slide;

a thumb flap connected to said upper portion of said top flap;

a bottom flap having an upper portion and a lower portion, said bottom flap being connected at its upper portion to said back wall, said bottom flap being separated from said back wall by a second fold line;

a bottom tongue connected to said lower portion of said bottom flap, said bottom tongue being separated from said bottom flap by a third fold line;

a second side wall connected at one side edge of said back wall, and a second side wall connected to another side edge of said back wall;

a front wall connected to said second side wall, said front wall having an elongated opening, said front wall also having a recess on an upper edge thereof;

a first side wall connected to an edge of said front wall;

a partition connected at a second side edge of said back wall, said partition having an upper end and a lower end, said upper end comprising a first corner flap and said lower end comprising a second corner flap, said partition having an adhesive coating;

a supporting wall connected to said partition, said supporting wall having an elongated opening;

a top inner wall connected to an upper end of said supporting wall;

a top tongue connected to said top inner wall;

a bottom inner wall connected to a bottom end of said supporting wall;

a side inner wall connected to said supporting wall, said side inner wall having an upper end and a lower end, said upper end comprising a third corner flap and said lower end comprising a fourth corner flap, said inner wall having an adhesive coating; and said supporting wall having a first slit adjacent to said partition and a second slit adjacent to said side inner wall;

wherein:

said front wall, said supporting wall, said bottom flap and said top flap are folded over to form a box;

said slide is disposed within said box, each of said straps being inserted into a corresponding one of said slits; and said box has an open position in which said elongated openings are aligned and in which the contents of said box may be poured out of the box through said elongated openings only, and a closed position in which said elongated openings are not aligned and in which the contents of said box cannot be poured out of said box.

* * * * *